US012044152B2

(12) United States Patent
Roberts et al.

(10) Patent No.: US 12,044,152 B2
(45) Date of Patent: Jul. 23, 2024

(54) ROCKER CONTROL IN LOST MOTION ENGINE VALVE ACTUATION SYSTEMS

(71) Applicant: Jacobs Vehicle Systems, Inc., Bloomfield, CT (US)

(72) Inventors: Gabriel S. Roberts, Wallingford, CT (US); Marc Silva, Willington, CT (US); Dong Yang, West Hartford, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 18/249,720

(22) PCT Filed: May 7, 2021

(86) PCT No.: PCT/IB2021/053904

§ 371 (c)(1),
(2) Date: Apr. 19, 2023

(87) PCT Pub. No.: WO2022/106907

PCT Pub. Date: May 27, 2022

(65) Prior Publication Data

US 2023/0383676 A1 Nov. 30, 2023

Related U.S. Application Data

(60) Provisional application No. 63/198,902, filed on Nov. 20, 2020.

(51) Int. Cl.

| | |
|---|---|
| ***F01L 13/06*** | (2006.01) |
| ***F01L 1/18*** | (2006.01) |
| *F01L 1/46* | (2006.01) |

(52) U.S. Cl.

CPC ..... *F01L 13/065* (2013.01); *F01L 1/181* (2013.01); *F01L 2001/467* (2013.01)

(58) Field of Classification Search

CPC .... F01L 13/065; F01L 1/181; F01L 2001/467

(Continued)

(56) References Cited

U.S. PATENT DOCUMENTS

| | | | |
|---|---|---|---|
| 2,047,446 | A | 7/1936 | Leonard |
| 6,234,143 | B1 | 5/2001 | Bartel et al. |

(Continued)

FOREIGN PATENT DOCUMENTS

| | | | |
|---|---|---|---|
| CN | 201461013 | U | 5/2010 |
| CN | 105863766 | A | 8/2016 |

(Continued)

OTHER PUBLICATIONS

International Search Report for International Application No. PCT/IB2021/053904 dated Jul. 6, 2021, 3 pages.

(Continued)

*Primary Examiner* — Hai H Huynh
(74) *Attorney, Agent, or Firm* — Jordan IP Law, LLC

(57) ABSTRACT

Systems for valve actuation in internal combustion engines provide rocker control components in the form of biasing mechanisms for biasing the valve side of a lost motion rocker toward the engine valves. This may prevent gaps in the valvetrain, particularly when used with cams having sub-base circle auxiliary motion event profiles. Valvetrain components, such as an e-foot engaging a valve bridge, may be provided with a biasing mechanism and stroke limiting and retaining components to maintain engagement between the e-foot and valve bridge, to control stability of the valve bridge, and to make assembly/disassembly easier.

15 Claims, 9 Drawing Sheets

(58) Field of Classification Search
USPC ..... 123/90.12, 90.22, 90.39, 90.4, 320, 321
See application file for complete search history.

(56) References Cited

U.S. PATENT DOCUMENTS

| | | | | |
|---|---|---|---|---|
| 6,253,730 | B1 | 7/2001 | Gustafson | |
| 6,321,701 | B1 | 11/2001 | Vorih et al. | |
| 6,354,265 | B1 | 3/2002 | Hampton et al. | |
| 11,255,226 | B2 * | 2/2022 | Baltrucki | F01L 1/267 |
| 2003/0221663 | A1 | 12/2003 | Vanderpoel et al. | |
| 2005/0211206 | A1 | 9/2005 | Ruggiero et al. | |
| 2007/0028878 | A1 | 2/2007 | Persson et al. | |
| 2014/0083381 | A1 | 3/2014 | Roberts et al. | |
| 2014/0182536 | A1 | 7/2014 | Yang | |
| 2019/0145289 | A1 | 5/2019 | Ferreira et al. | |
| 2019/0264584 | A1 | 8/2019 | Baltrucki et al. | |
| 2019/0293001 | A1 | 9/2019 | Baltrucki et al. | |
| 2020/0131946 | A1 | 4/2020 | Persson | |
| 2022/0298935 | A1 | 9/2022 | Baltrucki | |
| 2023/0151743 | A1 * | 5/2023 | Metsack | F01L 1/146<br>123/90.27 |

FOREIGN PATENT DOCUMENTS

| | | | |
|---|---|---|---|
| JP | 2009522487 | A | 6/2009 |
| WO | 2011017631 | A1 | 2/2011 |
| WO | 2017053867 | A1 | 3/2017 |
| WO | 2019133658 | A1 | 7/2019 |
| WO | 2020173607 | A1 | 9/2020 |
| WO | 2020229969 | A1 | 11/2020 |
| WO | 2021164948 | A1 | 8/2021 |
| WO | 2022106907 | A1 | 5/2022 |

OTHER PUBLICATIONS

Written Opinion of the International Search Authority for International Application No. PCT/IB2021/053904 dated Jul. 6, 2021, 4 pages.

International Search Report for International Application No. PCT/IB2023/050091; dated Mar. 20, 2023; 3 pages.

Written Opinion of the Internatinal Search Authority for International Application No. PCT/IB2023/050091; dated Mar. 20, 2023; 3 pages.

* cited by examiner

ROCKER CONTROL IN LOST MOTION ENGINE VALVE ACTUATION SYSTEMS

RELATED APPLICATIONS AND PRIORITY CLAIM

This application claims priority to U.S. provisional application Ser. No. 63/198,902, filed on Nov. 20, 2020 and titled LOST MOTION ROCKER BRAKE BIASING SYSTEM, the subject matter of which is incorporated by reference herein in its entirety.

TECHNICAL FIELD

This disclosure relates generally to systems for actuating valves in internal combustion engines. More particularly, this disclosure relates to engine valve actuation systems with features for controlling rocker arm motion that are particularly suitable for lost motion valve actuation systems.

BACKGROUND

Internal combustion engines require valve actuation systems to control the flow of combustible components, typically fuel and air, to one or more combustion chambers during operation. Such systems control the motion and timing of intake and exhaust valves during engine operation. In a positive power mode, intake valves are opened to admit fuel and air into a cylinder for combustion and exhaust valves are subsequently opened to allow combustion products to escape the cylinder. This operation is typically called a "positive power" operation of the engine and the motions applied to the valves during positive power operation are typically called "main event" valve actuation motions. Auxiliary valve actuation motion, such as motion that results in engine braking (power absorbing), may be accomplished using "auxiliary" events imparted to one or more of the engine valves.

Valve movement during main event positive power modes of operation is typically controlled by one or more rotating cams as motion sources. Cam followers, push rods, rocker arms and other elements disposed in a valvetrain provide for direct transfer of motion from the cam surface to the valves. The use of a valve bridge may impart motion to plural valves from a single upstream valvetrain. For auxiliary events, "lost motion" devices may be utilized in the valvetrain to facilitate auxiliary event valve movement. Lost motion devices refer to a class of technical solutions in which valve motion is modified compared to the motion that would otherwise occur as a result of actuation by a respective cam surface alone. Lost motion devices may include devices whose length, rigidity or compressibility is varied and controlled in order to facilitate the selective occurrence of auxiliary events in addition to, or as an alternative to, main event operation of valves. Auxiliary events may also be facilitated by dedicated cam systems in which a separate auxiliary or braking cam and valvetrain may be used to impart auxiliary motion to one or more valves to facilitate the selective occurrence of auxiliary events.

In braking, and other auxiliary lost motion applications, multiple valve events may be incorporated into the same cam lobe and different events activated or deactivated, based on the selective extension or retraction of a lost motion element, such as an actuator piston. Lost motion cam systems typically use at least one cam with different profiled lift sections on the same cam lobe to impart motion for respective main event and one or more auxiliary events.

These different profiled lift sections are activated or deactivated using a separate lost motion mechanism, such as a piston or actuator, located in the valvetrain. Example auxiliary events include engine braking, early exhaust valve opening (EEVO), late intake valve closing (LIVC) lift events, and internal exhaust gas recirculation events (IEGR) and can be imparted to one or more valves in a valve set (i.e., two exhaust valves for a respective cylinder). Lost motion auxiliary valve lift systems, such as lost motion braking systems may employ a single rocker associated with the lost motion cam and a valve bridge associated with the rocker for actuating two engine valves in main event motion. Auxiliary valve lift or braking motion on one of the valves is facilitated by an auxiliary valve lift or braking actuator, which is a lost motion device that may be housed in the rocker and may selectively impart auxiliary or braking motion to the valve by way of a bridge pin disposed in the bridge and providing for independent motion relative thereto. The auxiliary valve lift or braking actuator is selectively activated and deactivated such that the auxiliary or braking event lift profile section or lobe on the lost motion cam only results in auxiliary or braking motion on the valve when an auxiliary event, such as engine braking is desired.

Some lost motion valve actuation systems may utilize sub-base circle lost motion profiles on one or more cams. In such systems, a main event valve lift profile may be provided on the cam above the cam base circle, whereas lost motion profiles are provided on the same cam below the cam base circle. During main event motion, with the lost motion actuator deactivated, a lost motion gap is produced in the valvetrain and the sub-base circle profiles are, as a result, lost and not passed on to the engine valve(s). When the lost motion actuator is activated, the lost motion gap in the valvetrain is taken up, and the auxiliary motion profile(s) may be conveyed to the engine valve(s).

One inherent concern around the design of lost motion systems, including lost motion rocker brake systems, is that when the auxiliary valve lift (lost motion) actuator is deactivated, gaps in the associated valvetrain may be created. The gaps created may be particularly large in lost motion systems that utilize sub-base circle auxiliary motion profiles. In such cases, there is a need to control the motion of the rocker arm to prevent or reduce the degree of uncontrolled motion that may result from the existence of gaps in the valvetrain.

Existing solutions for rocker control in such lost motion environments have utilized biasing mechanisms, which bias a cam side of the rocker towards the cam so that the rocker cam follower is in constant contact with the cam, even during events that cause gaps in the valvetrain, thus preventing uncontrolled motion of the rocker during these events. Biasing mechanisms that achieve these results may include spring bars, actuator piston springs or an under-mounted rocker bias spring.

Cam side rocker biasing solutions in the prior art are not without disadvantages. For example, in such solutions, particularly when sub-base circle auxiliary events are utilized, strong biasing forces, on the order of several hundred Newtons of force, and appropriately designed biasing components may be required to maintain contact between the cam roller (follower) and cam lobe in the brake off condition—when the auxiliary motion lift actuator is in a deactivated state. Such biasing forces are required because, with the auxiliary motion lift actuator deactivated, the full mass of the rocker arm is typically exposed to the acceleration and deceleration forces generated by the cam and, as a result, the rocker arm and cam follower may otherwise tend to separate from the cam surface.

It would therefore be advantageous to provide systems that address the aforementioned shortcoming and others in the prior art.

SUMMARY

Responsive to the foregoing challenges, and according to one aspect, the instant disclosure provides various embodiments of valve actuation systems with features for controlling rocker motion, which may be applied in lost-motion systems. More particularly, the disclosure describes systems in which a biasing component is arranged and adapted to bias a valve side of the rocker in a direction that is towards the engine valves. Additional aspects may provide biasing components on an e-foot that cooperates with a valve bridge to eliminate gaps and further enhance control of the rocker and valve bridge. The e-foot may further be provided with a defined stroke and a retaining feature to maintain the e-foot in an assembled state even when the e-foot is not in contact with a valve bridge (i.e., when the rocker and bridge are disassembled). The described systems facilitate rocker control even during deactivation of a lost motion component, where gaps in the valvetrain might otherwise be present.

According to one aspect the disclosure provides a system for actuating at least one of two or more engine valves in an internal combustion engine, the system comprising: at least one motion source defining main event motion and at least one auxiliary motion; a rocker for conveying motion from the motion source to the at least one valve, the rocker having a motion source side arranged to receive motion from the motion source and a valve side arranged to direct motion to the least one valve; a valvetrain cooperating with the rocker valve side to convey motion from the rocker valve side to the at least one valve; the valvetrain including a lost motion component, disposed on the rocker; the lost motion component being configurable to an activated state, in which the lost motion component conveys auxiliary rocker motion to the at least one valve, and being configurable to a deactivated state, in which the lost motion component absorbs motion that would otherwise be conveyed to the at least one valve; and a rocker motion control component adapted to control the motion of the rocker when the lost motion component is in the deactivated state.

According to a further aspect, the at least one auxiliary braking motion defined on the motion source is defined in a sub-base circle portion of a cam.

According to a further aspect, the lost motion component is adapted to lose an amount of motion corresponding to the sub-base circle portion of the cam.

According to a further aspect, the rocker motion control component includes a biasing mechanism.

According to a further aspect, the biasing mechanism biases the rocker towards the valve side.

According to a further aspect, the biasing mechanism includes a spring.

According to a further aspect, the spring is a flatspring, coil spring or torsion spring.

According to a further aspect, the valvetrain includes a valve bridge and an e-foot for engaging the valve bridge.

According to a further aspect, the system further comprises an e-foot biasing component for maintaining the e-foot in contact with the valve bridge.

According to a further aspect, the e-foot biasing component comprises a spring cooperating with an e-foot cup.

According to a further aspect, the spring engages an annular shoulder on the e-foot cup.

According to a further aspect, the e-foot is configured to be extendable in length.

According to a further aspect, the e-foot has a limited stroke.

According to a further aspect, the e-foot stroke is defined by a bottom surface of an e-foot cup and an inwardly extending lip on an upper end of the e-foot cup.

According to a further aspect, the e-foot is configured to be extendable to a defined limit such that the e-foot remains assembled on the rocker when the rocker is not assembled with the bridge.

Other aspects and advantages of the disclosure will be apparent to those of ordinary skill from the detailed description that follows, and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto.

DETAILED DESCRIPTION

Figure 1:
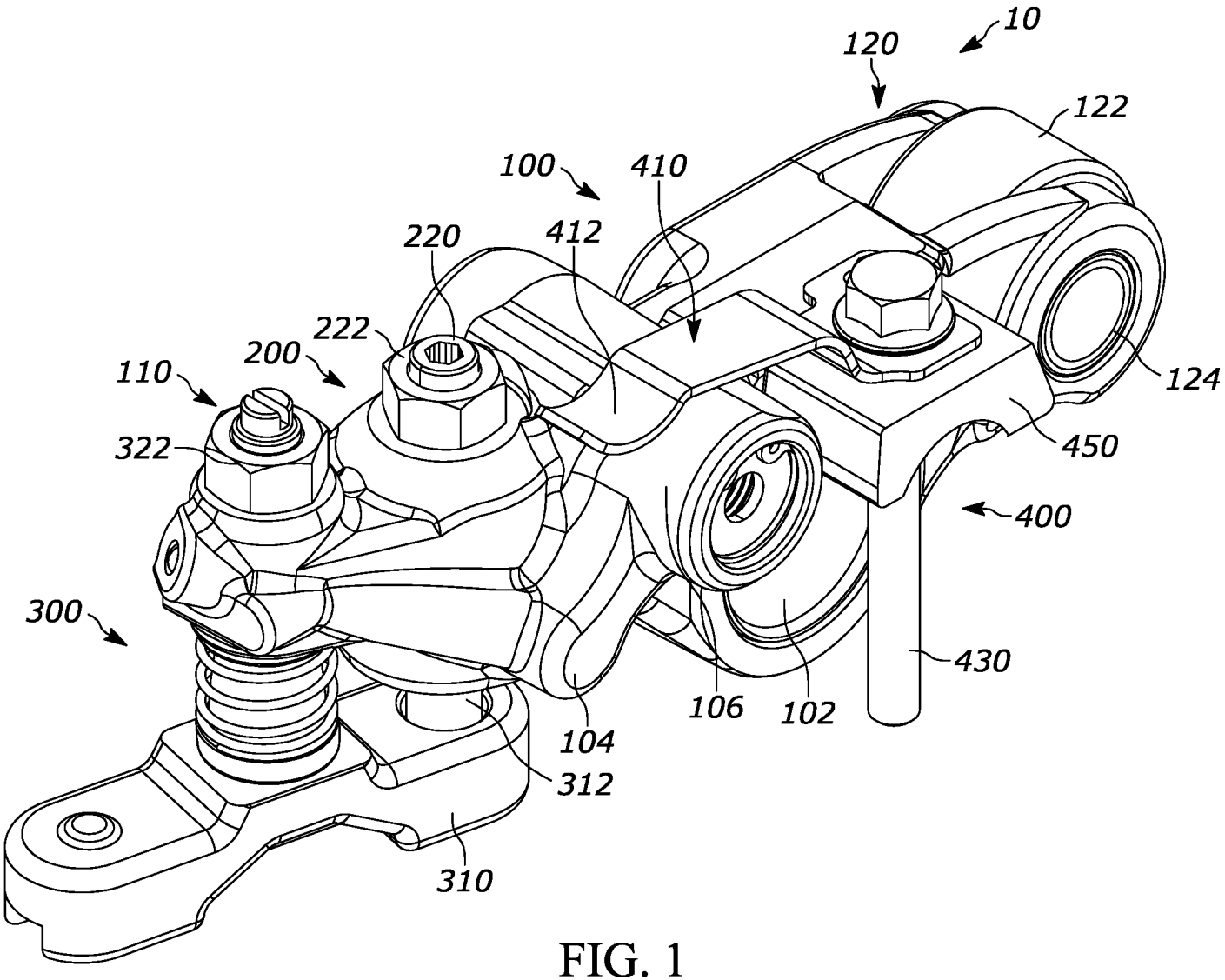
FIG. 1 is a perspective view of an example lost motion rocker assembly, e-foot and valve bridge, including a rocker biasing component in accordance with aspects of the instant disclosure.
Figure 2:
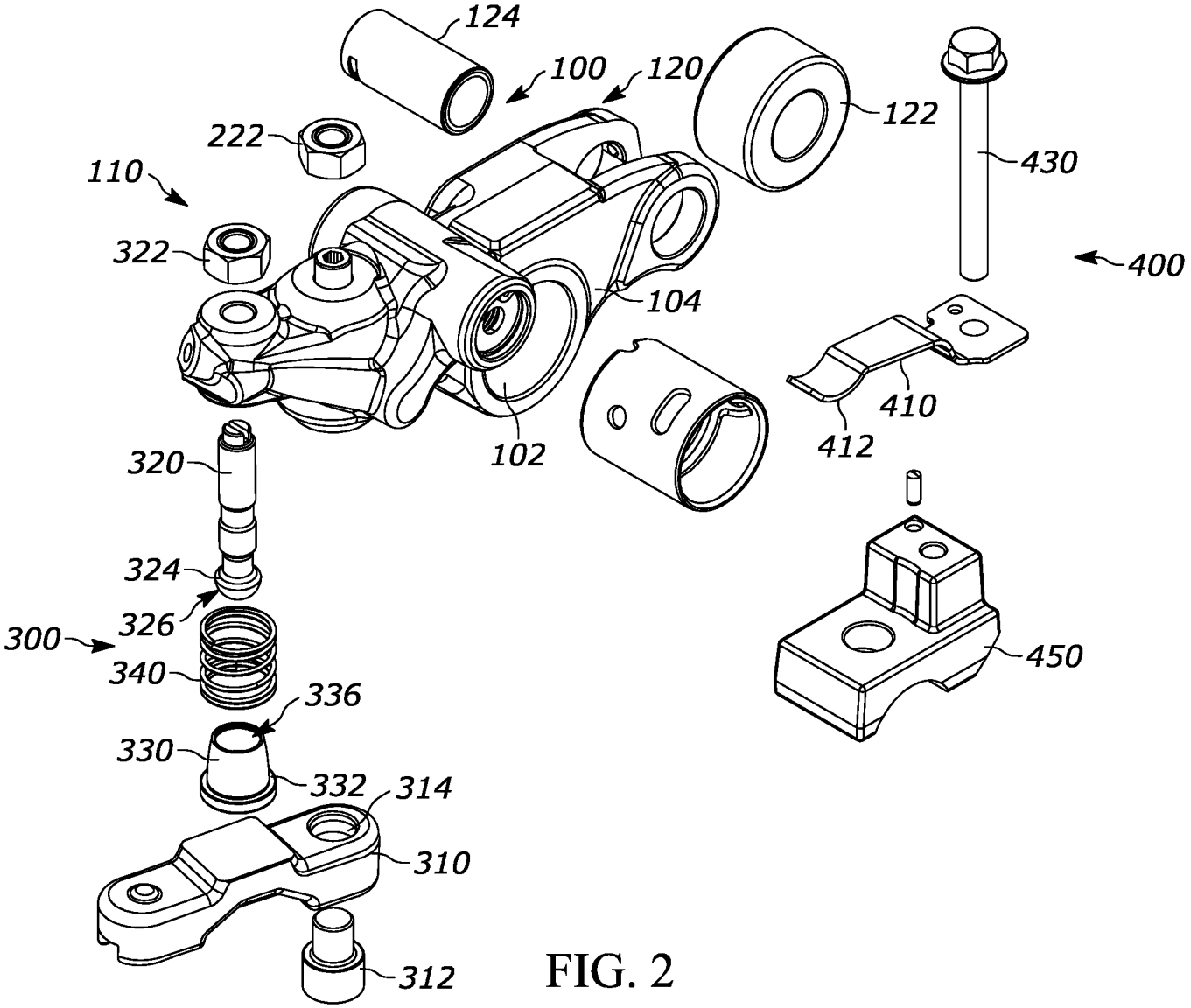
FIG. 2 is an exploded, perspective view of the example lost motion rocker assembly, e-foot and valve bridge of FIG. 1

The functionality of components in an example valve actuation system according to aspects of the disclosure will first be explained generally, and in the context of a more detailed example implementation. These general and example descriptions are intended to be illustrative and not exhaustive or limiting with regard to the inventions reflected in this disclosure.

Referring to FIGS. 1-5 and 8, an example valve actuation system 10 may include a rocker 100, a lost motion component 200, a valve bridge and e-foot assembly 300, and a rocker biasing component 400. Rocker 100 may include a main rocker body 104, a valve side 110 and a cam side 120 on opposite sides of a rocker shaft journal 102. Cam side 120 may include a cam roller or follower 122 which may receive motion from a motion source in the form of a cam (see FIG. 8). Cam follower 122 may be secured to the main rocker body 104 by a follower shaft 124. As previously mentioned, rocker main body 104 may include integral bores and cavities for housing the lost motion component 200, as well as control components and passages for controlling hydraulic fluid used to activate and deactivate the lost motion component 200, as is generally known in the art.

Valve side 110 of the rocker 100 may include an e-foot and valve bridge assembly 300, which may constitute a portion of a main event load path for conveying main event motion from the rocker 100 to a valve bridge 310, and ultimately to two engine valves (see FIG. 5) that are arranged to receive motion from the valve bridge 310. A bridge pin 312 may extend within a bridge bore 314 to transmit motion from the lost motion component 200 (when activated) to one of the engine valves, thereby providing for auxiliary events and auxiliary motion of the one engine valve.

Figure 3:
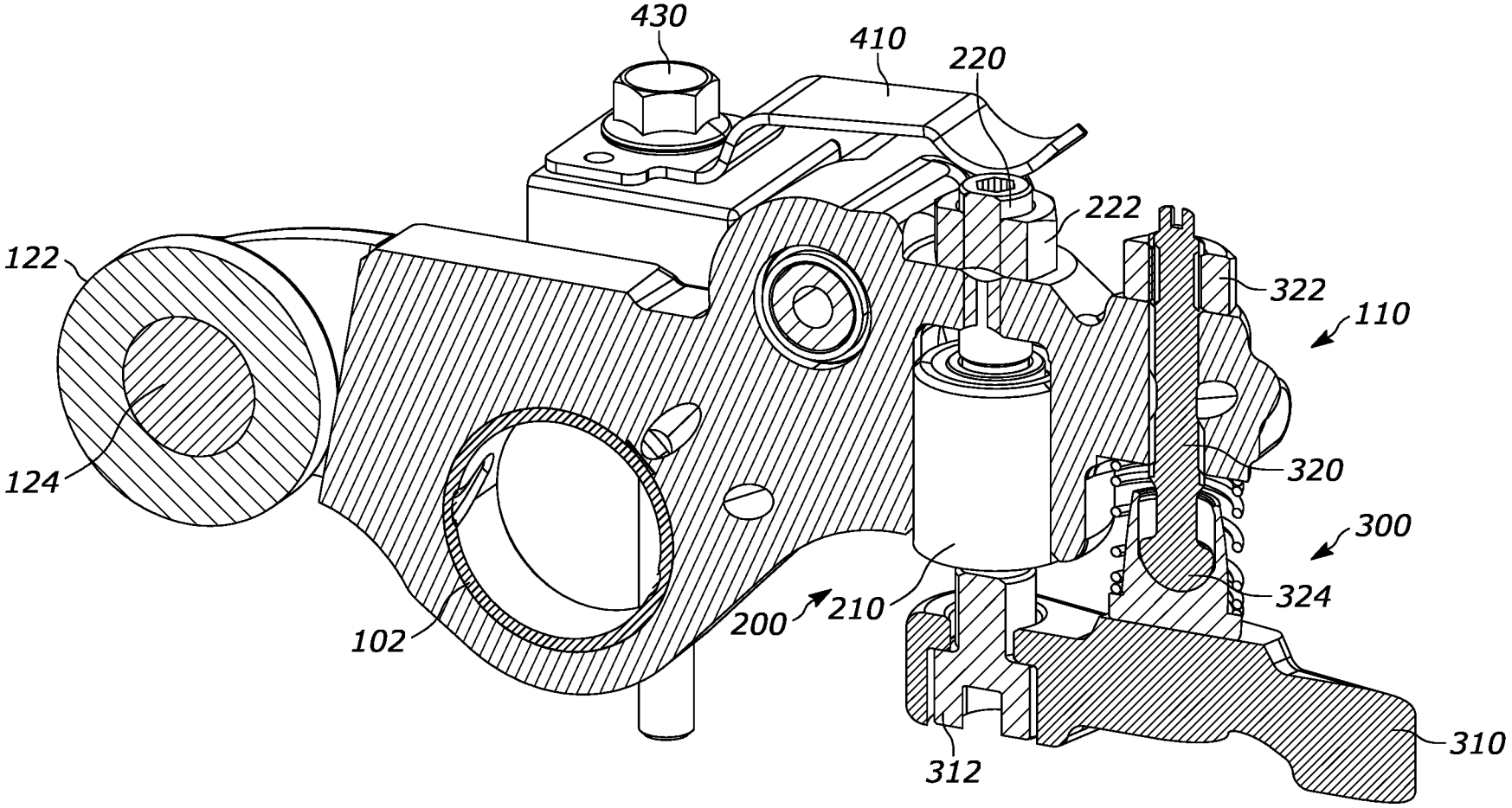
FIG. 3 is a cross-section showing internal features of the example lost motion rocker, e-foot and valve bridge of FIG. 1, with a lost motion component in a deactivated state.
Figure 4:
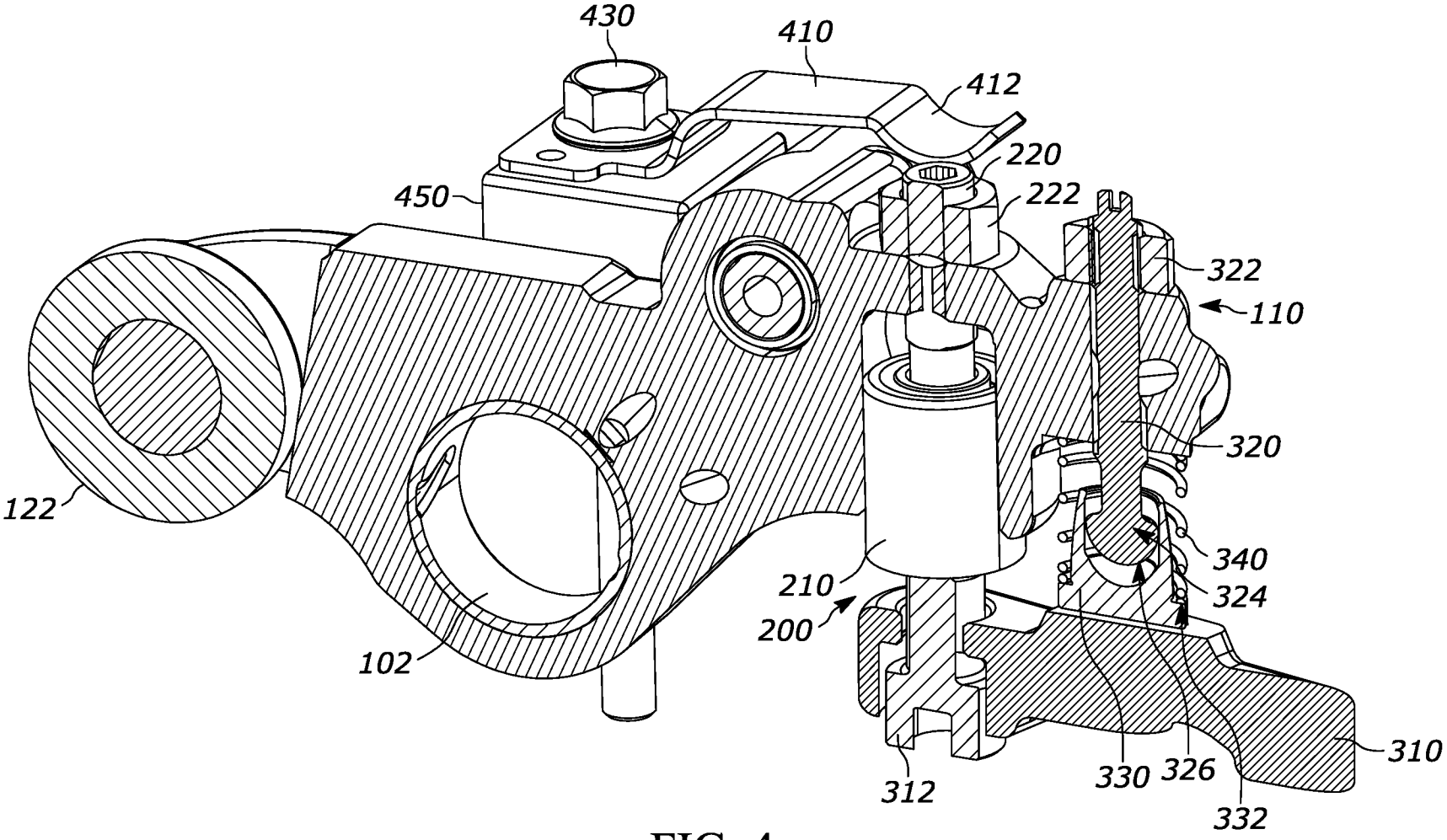
FIG. 4 is a cross-section showing internal features of the example lost motion rocker, e-foot and valve bridge of FIG. 1, with a lost motion component in an activated state.

As best seen in FIGS. 3 and 4, lost motion component 200 may include an actuator piston 210, which, when extended, engages and transmits motion to an end of the bridge pin 312. Actuator piston 210 may cooperate with a lost motion actuator post 220, and a lost motion actuator spring to secure the actuator piston 210 to the rocker 100 while providing for sliding movement of the actuator piston 210 relative to the rocker 100. Actuator piston 210 may extend under hydraulic pressure when the lost motion component 200 is activated and retract under force of the lost motion actuator spring when the lost motion component 200 is deactivated. The lost motion actuator post 220 may be secured to the rocker 100 with a threaded fastener 222, in a manner that permits adjustment of the axial position of the lost motion actuator post 220 relative to the rocker 100. As will be recognized from this disclosure, lost motion component 200 may constitute a portion of an auxiliary load path, which, when the lost motion component 200 is activated, will convey auxiliary motion from the rocker 100 to the bridge pin 312 and to one of the engine valves to support auxiliary motion of the one engine valve. FIG. 3 shows the lost motion component 200 in a deactivated state, with piston 210 retracted into the rocker 100. FIG. 4 shows the lost motion component 200 in an activated state, with piston 210 extending from the rocker 100 and engaging bridge pin 312, which is in an extended position.

According to aspects of the disclosure, a biasing component 400 may be provide, in this example, as a flatspring 410 extending from a pedestal 450, or other fixed structure within the engine overhead environment, and secured thereto with a threaded fastener (i.e., a machine bolt) 430. Flatspring 410 may be constructed of a spring steel or other material with some degree of resilience and flexibility. A rocker engaging end 412 of the flatspring 410 may be shaped and positioned to engage a portion of the rocker body 104, such as a curved housing or boss portion 106 for housing control components (see FIGS. 1 and 5). Flatspring (or leaf spring) 410 may be arranged and adapted to exert a biasing force on the valve side 110 of the rocker 100 in a direction that tends to force the valve side of the rocker 110 towards the valves (i.e., counterclockwise about the rocker journal 102 in FIGS. 1 and 5). As will be recognized from the instant disclosure, other mechanisms and arrangements may be utilized in place of the example flatspring 410 to provide valve side biasing of the rocker 100. For example, a compression spring could be arranged on the valve side of the rocker 100 and secured to a fixed portion of the engine to exert a valve side force. Alternatively, a torsion spring could be arranged around the rocker shaft or other structure to exert such a force. Still further, a hydraulic piston, tension spring or other force providing implement could be used.

Figure 8:
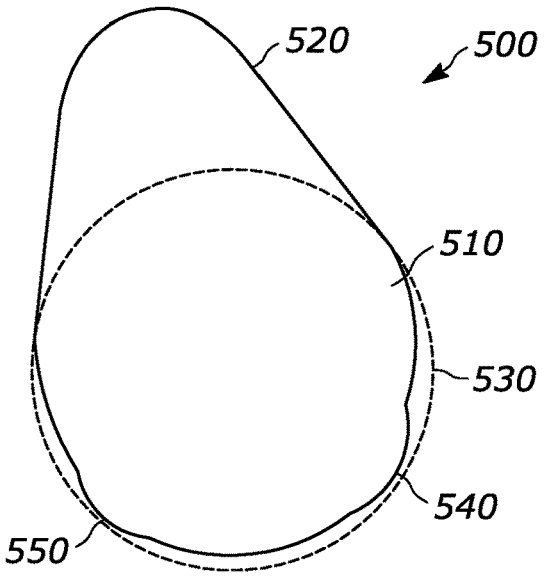
FIG. 8 is a cross section of an example cam profile with auxiliary motion defined in sub-base circle portion of the cam.

As will be recognized from the disclosure, when the lost motion component 200 is activated, sub-base circle auxiliary motion profiles of a motion source may be conveyed to one of the engine valves. Referring additionally to FIG. 8, an example motion source 500 may include a cam 510 having a main event profile 520 extending radially beyond a base circle 530 to define main event valve motion. Auxiliary event profiles 540 and 550, which may define auxiliary events, may be provided within (beneath) base circle 530. As will be recognized from the instant disclosure, when the rocker 100 is biased in the direction of the valves by biasing component 400, when the lost motion component 200 is deactivated, only main event motion is conveyed from the cam 510. In the deactivated state of the lost motion component, when the sub-base circle surface of the cam 500 encounters cam follower 122, a gap will exist between the cam roller 122 and the motion source 500 such that the sub-base circle auxiliary motion defined by auxiliary motion profiles 540 and 550 will not be conveyed to the rocker 100. On the other hand, when the lost motion component 200 is activated, the auxiliary motion profiles 540 and 550 will engage the cam follower 122 such that the auxiliary motion defined thereby will be conveyed via the bridge pin 312 to one of the engine valves.

Figure 5:
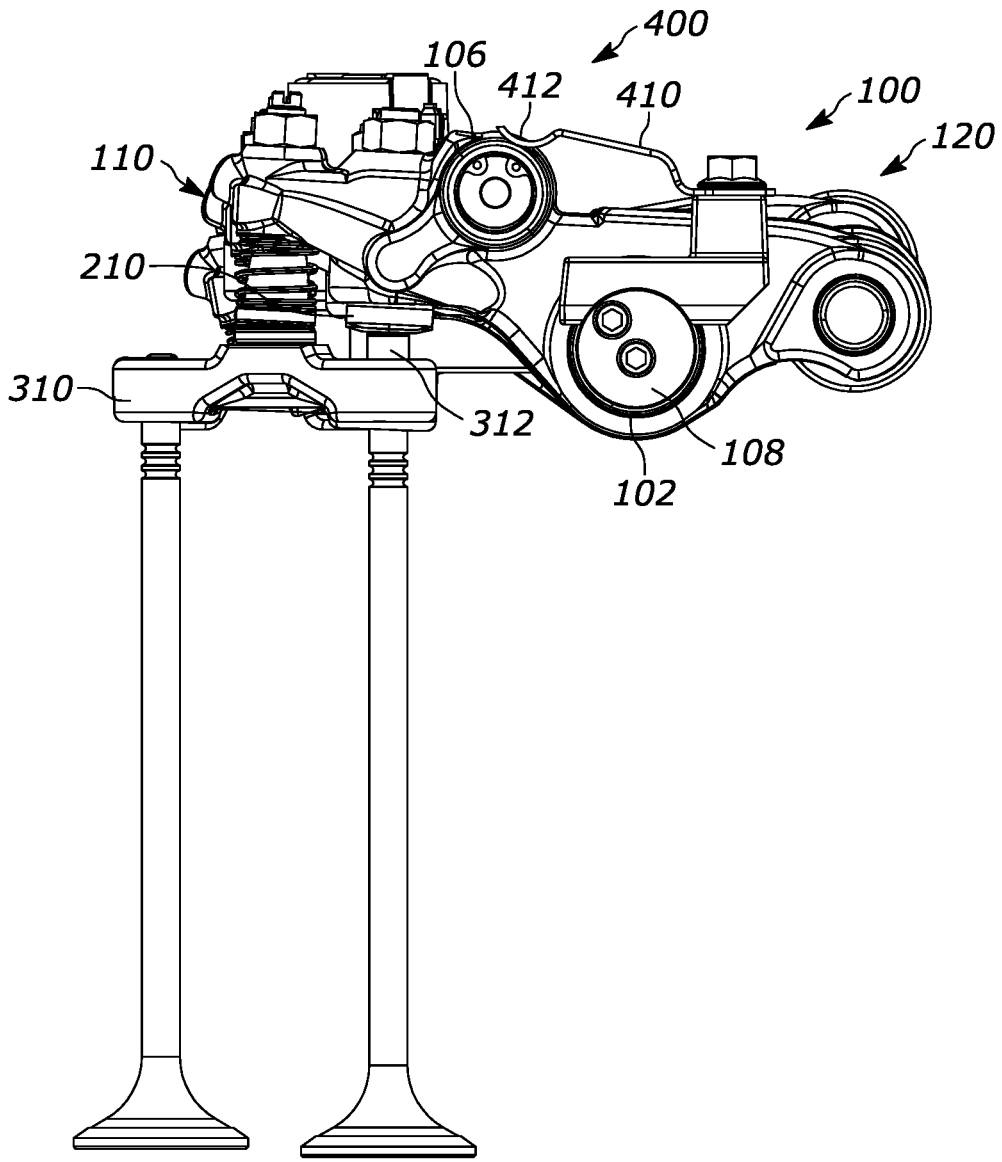
FIG. 5 is a side view of an example lost motion rocker, e-foot and valve bridge in an engine environment with two valves and a rocker shaft.

FIG. 5 is a side view showing a biasing component 400 engaging the valve side 110 of the rocker 100. Particularly, an arcuate rocker engaging end 412 of a flatspring or leaf spring 410 is arranged to engage a cylindrical or rounded housing portion 106 of the rocker 100. FIG. 5 also shows a pair of engine valves engaging the valve bridge 310, as well as a rocker shaft 108 disposed in the rocker shaft journal 102.

According to aspects of the disclosure, the e-foot and bridge assembly 300 may be provided with features that provide further control of the rocker and valvetrain components and other advantages. More specifically, an e-foot biasing mechanism may be provided to control the rocker and e-foot to maintain contact between the e-foot and valve bridge. Referring again to FIGS. 1-5, and additionally to FIGS. 6 and 7, e-foot and valve bridge assembly 300 may include an e-foot post 320 secured to the valve side 110 of rocker 100 with a threaded fastener 322. E-foot post 320 may include a pivot end 324 having a semi-spherical surface 326 thereon for engaging a correspondingly shaped surface 336 on an e-foot pedestal or cup 330. An e-foot biasing spring 340 may be seated between an annular shoulder 332 on the e-foot pedestal 330 and a seating surface 160 (FIG. 6) on rocker 100. Spring 340 may thus provide a biasing force on the e-foot pedestal 330, tending to force the pedestal 330 against the valve bridge 310. With the valve side biasing mechanism, the e-foot biasing mechanism 300 functions advantageously to keep the e-foot pedestal 330 in contact with the valve bridge to prevent excessive bridge dynamics during a handoff event, transient event, or valve closing event. For example, when the lost motion rocker actuator piston activates the inboard exhaust valve, for example, in a braking operation, a large gap could otherwise form between the e-foot pedestal 330 and the valve bridge 310. The e-foot biasing mechanism 300 may prevent the formation of such a large gap, and provided added control and stability to the valvetrain components.

Figure 6:
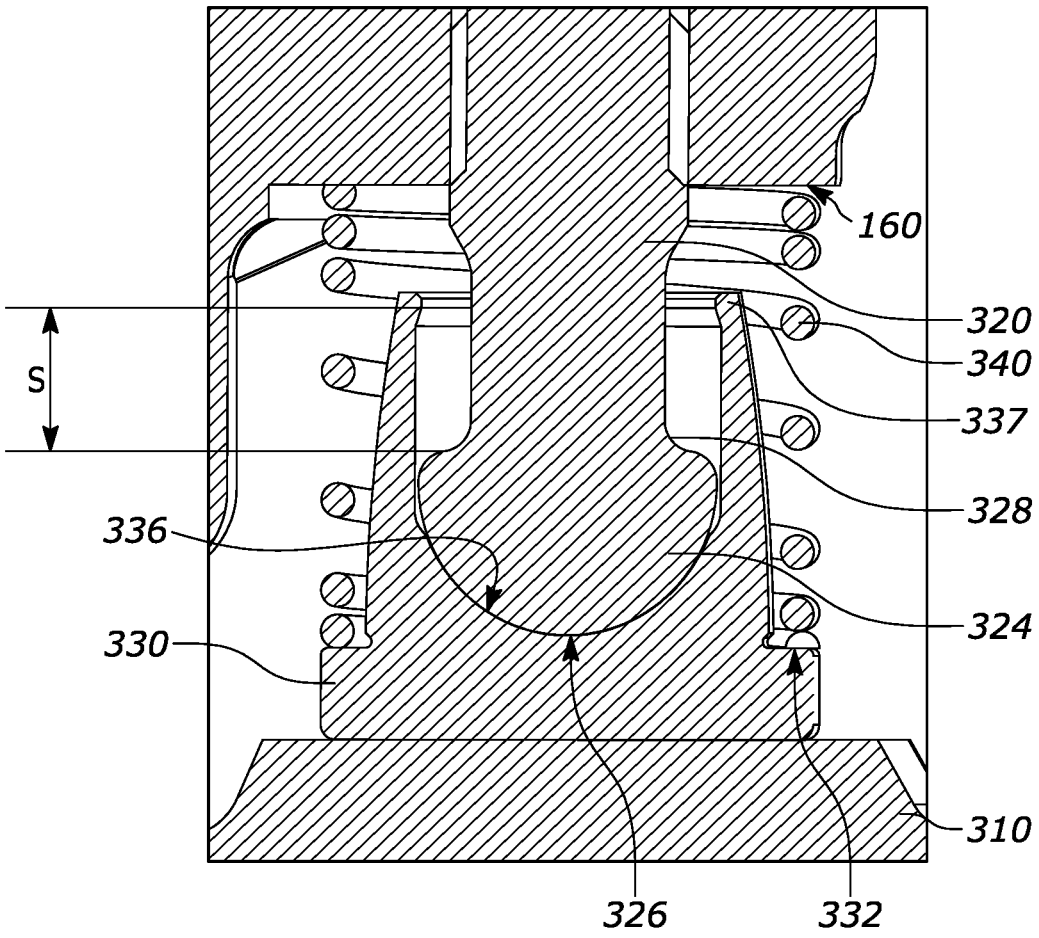
FIG. 6 is a detailed cross section of an example e-foot configuration in a compressed (brake-off) state.
Figure 7:
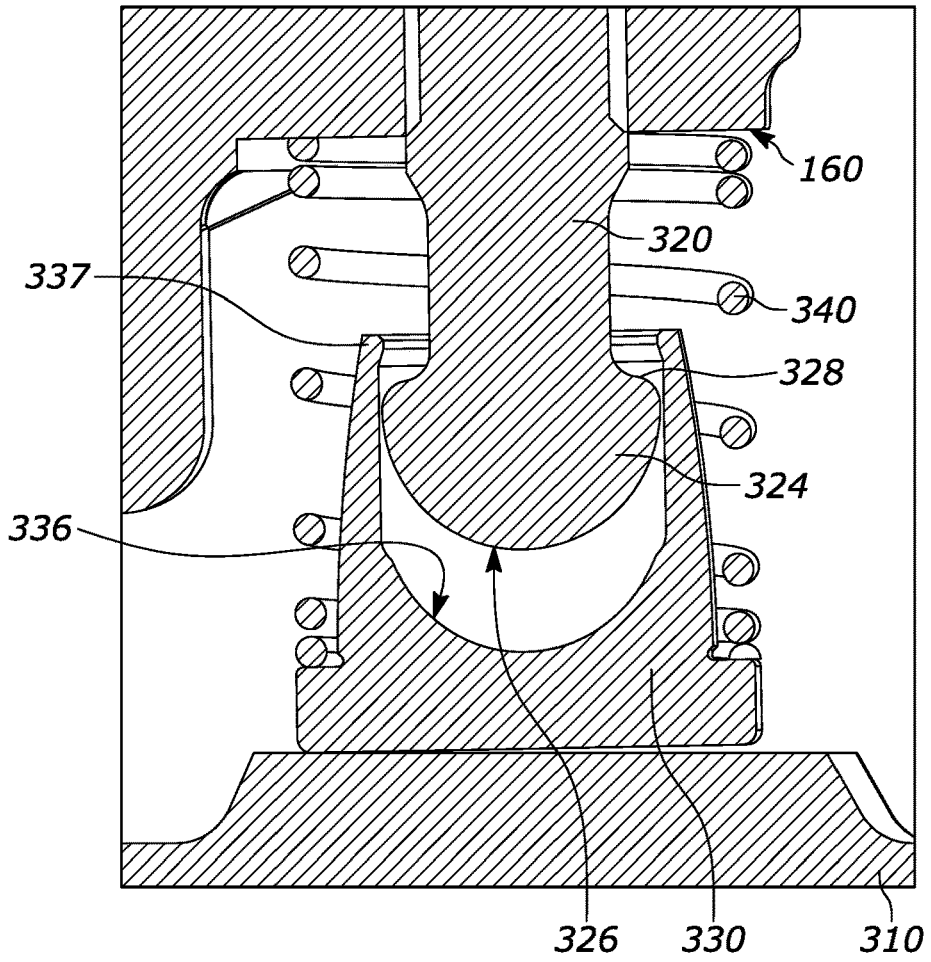
FIG. 7 is a detailed cross section of an example e-foot configuration in a stroke limited state (brake-on).

According to an aspect of the disclosure, the e-foot pedestal 330 may be provided with a predefined stroke or travel of length "S" (FIG. 6) relative to the e-foot post 320 to adjust position in all possible operating conditions. FIG. 6 shows the e-foot post 320 in a lowermost position relative to, and within the e-foot pedestal 330. This position may correspond to a brake off (lost motion component deactivated) position where main event motion is imparted to the valve bridge 310. FIG. 7 shows the e-foot post 320 in an intermediate position within the stroke length S relative to the e-foot pedestal 330. This position may correspond to a brake on (lost motion component activated), where a gap would otherwise exist between the e-foot pedestal 330 and valve bridge 310 if the e-foot pedestal stroke "S" were not provided. To implement the limited stroke, e-foot pedestal 330 may include a stroke limiting lip 337, or other interfering structure, extending inward from an upper end of the pedestal 330 and arranged and adapted to engage a shoulder 328 of the e-foot post end 324 and thereby restrict further movement of the e-foot post 320 relative to the e-foot pedestal 330. This predefined stroke, in combination with the e-foot biasing mechanism, facilitates the adjustment of the e-foot position for all operating conditions, including brake off (or lost motion component deactivated) state, which would typically otherwise result in a small gap between the e-foot pedestal 330 and the valve bridge 310, or a brake on (lost motion component activated) state, which would typically otherwise result in a large gap between the e-foot pedestal 330 and the valve bridge 310.

In accordance with another aspect of the disclosure, the e-foot pedestal may be provided with a retaining mechanism to retain the e-foot pedestal 330 on the e-foot post 320 when the valve bridge 310 is not present (i.e., during pre-assembly or removal). The stroke limiting lip 337 may be formed such that it extends to a degree that prevents removal of the e-foot pedestal 330 from the e-foot post 320. For example, the stroke limiting lip 337 may be formed on the interior of the upper edge of the pedestal 330 after the e-foot post 320 is positioned within the pedestal 330. Alternatively, a C-clip or other expanding device may be disposed in a channel or groove formed on the interior of the pedestal 330 and installed in that position after the pedestal 330 is installed on the e-foot post 320.

Figure 9:
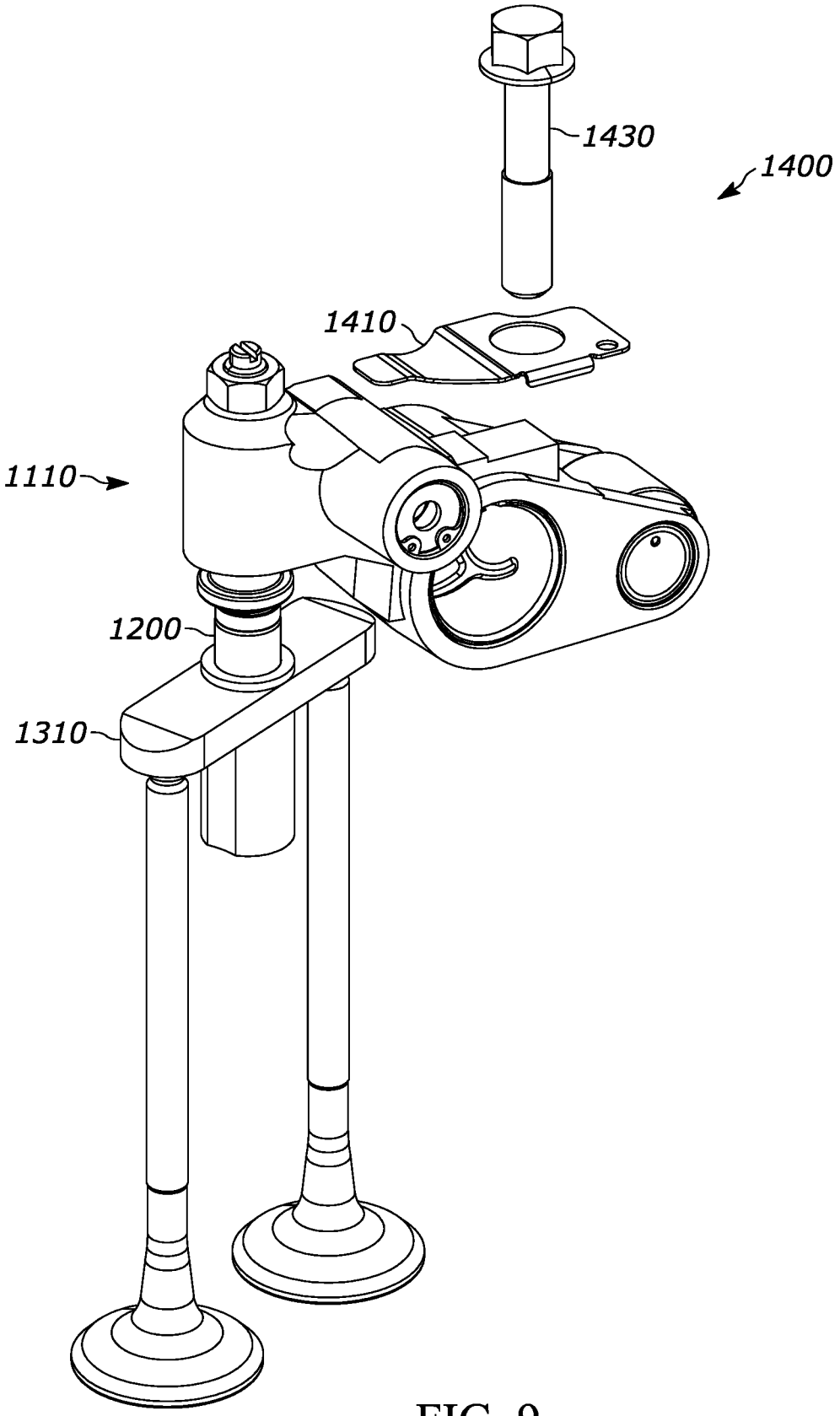
FIG. 9 is a perspective view of an example two valve opening lost motion rocker brake with biasing components shown in exploded view.
Figure 10:
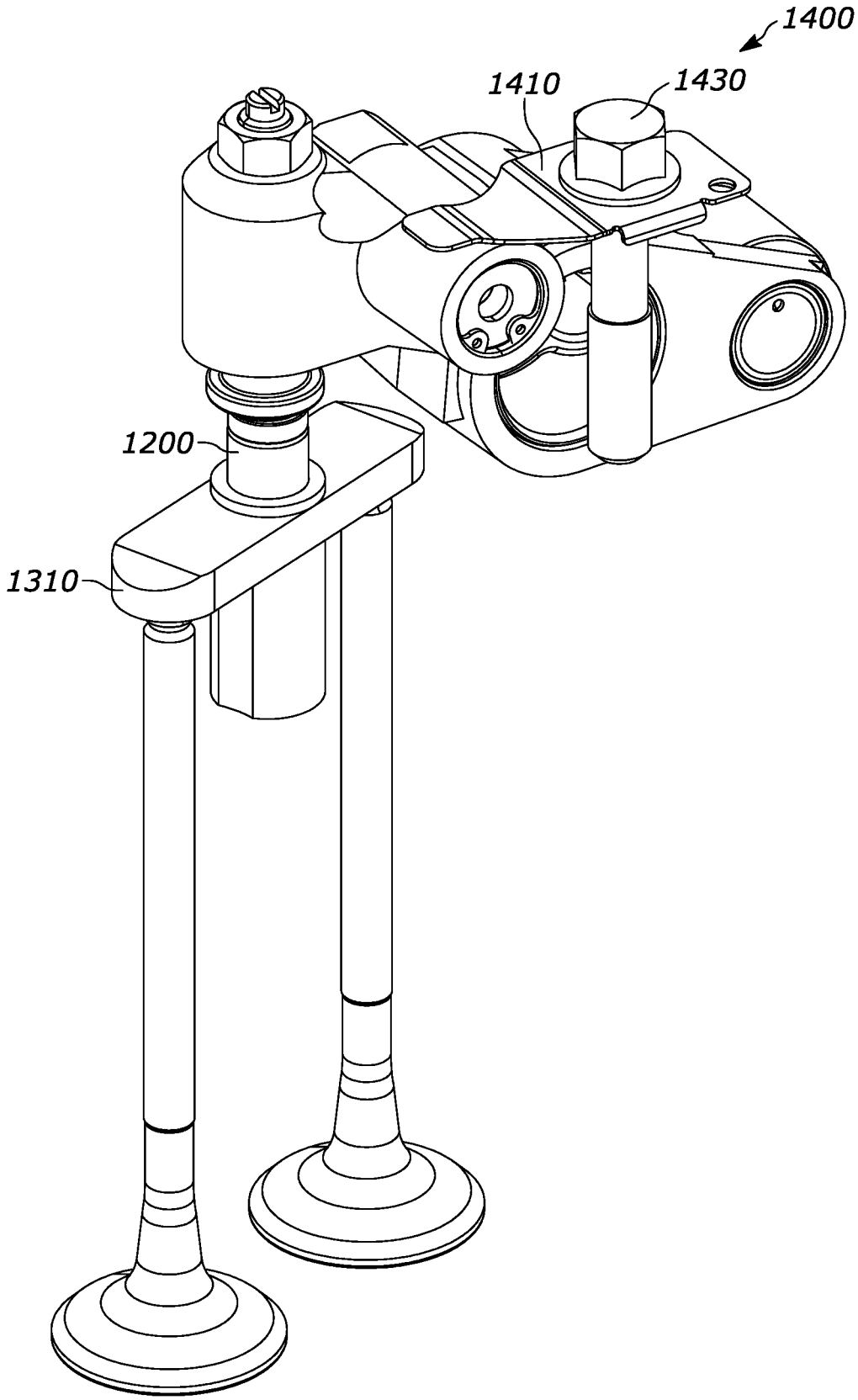
FIG. 10 is a perspective view of the example system of FIG. 9, with the biasing components shown assembled.

FIG. 9 is a perspective, exploded view, and FIG. 10 is a perspective assembled view of another example valve actuation system according to aspects of the disclosure. In this example, a two-valve opening lost motion rocker brake is applied. As will be recognized, the bridge pin 312 of the example system of FIGS. 1-8 is eliminated. Both valves are operated with the same motion by way of a valve bridge 1310, which may receive motion via an integrated collapsing or lost motion component 1200. In this example, both valves may be operated to perform auxiliary events or main event motion, depending on the motion source and activation/deactivation of the lost motion component 1200. The rocker is biased to the valve side with a biasing component 1400, which may include a leaf spring 1410 affixed to an engine head pedestal with a fastener 1430 and engaging the valve side 1110 of rocker. This example system configuration may be preferred for engines where the single valve lost motion in the above-described example in FIGS. 1-8 may not be feasible, such as in cases where the inboard valve is not accessible for components needed to implement single valve lost motion activation. The two-valve lost motion example system configuration may also be preferred for engines that require a single rocker arm for each exhaust valve due to other valvetrain limitations. As will be recognized, the integrated lost motion component 1200 may be utilized for cylinder deactivation.

As will be recognized from the disclosure, the above-described embodiments provide advantages and improvements to the art. For example, one benefit is that the bias spring force needed to control the rocker mass in a brake off condition may be significantly reduced with the valve side biasing configurations disclosed herein. Since the valve side of the rocker arm is biased toward the valves, sub-base circle cam events do not result in motion of the rocker arm when the lost motion element is deactivated. As a result, the rocker arm does not require large biasing forces to maintain contact with the cam surface. The only motion events that are imparted by the cam to the valves by the rocker are the main events. Thus, standard valve springs may be sized to keep the rocker in contact with the cam during such main event motion. By eliminating this need for large biasing forces, valvetrain component design can be simplified and costs reduced. Moreover, the system may have lower weight. As a result, parasitic losses that arise from increased weight and from the use of larger biasing forces during engine operation may be reduced and fuel economy may be improved. Another advantage is that manufacture and assembly may be simplified and made more cost-effective compared to the prior art. Flatsprings or leaf springs having sufficient biasing force to operate the above-described example systems according to the disclosure may be made more easily and at a lower cost compared to coil springs having the very large biasing forces required for rocker arm control in prior art systems.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A system for actuating at least one of two or more engine valves in an internal combustion engine, the system comprising;

at least one motion source defining main event motion and at least one auxiliary motion;

a rocker for conveying motion from the motion source to the at least one valve, the rocker having a motion source side arranged to receive motion from the motion source and a valve side arranged to direct motion to the least one valve;

a valvetrain cooperating with the rocker valve side to convey motion from the rocker valve side to the at least one valve;

the valvetrain including a lost motion component, disposed on the rocker, the lost motion component being configurable to an activated state, in which the lost motion component conveys rocker motion to the at least one valve, and being configurable to a deactivated state, in which the lost motion component absorbs motion that would otherwise be conveyed to the at least one valve; and a rocker motion control component secured to a fixed portion of the internal combustion engine and adapted to control the motion of the rocker when the lost motion component is in the deactivated state.

2. The system of claim 1, wherein the at least one auxiliary braking motion defined on the motion source is defined in a sub-base circle portion of a cam.

3. The system of claim 2, wherein the lost motion component is adapted to lose an amount of motion corresponding to the sub-base circle portion of the cam.

4. The system of claim 1, wherein the rocker motion control component includes a biasing mechanism.

5. The system of claim 4, wherein the biasing mechanism biases the rocker towards the valve side.

6. The system of claim 5, wherein the biasing mechanism includes a spring.

7. The system of claim 6, wherein the spring is a flat-spring.

8. The system of claim 1, wherein the valvetrain includes a valve bridge and an e-foot for engaging the valve bridge.

9. The system of claim 8, wherein the system further comprises an e-foot biasing component for maintaining the e-foot in contact with the valve bridge.

10. The system of claim 9, wherein the e-foot biasing component comprises a spring cooperating with an e-foot cup.

11. The system of claim 10, wherein the spring engages an annular shoulder on the e-foot cup.

12. The system of claim 8, wherein the e-foot is configured to be extendable in length.

13. The system of claim 8, wherein the e-foot has a limited stroke.

14. The system of claim 13, wherein the stroke is defined by a bottom surface of an e-foot cup and an inwardly extending lip on an upper end of the e-foot cup.

15. The system of claim 8, wherein the e-foot is configured to be extendable to a defined limit such that the e-foot remains assembled on the rocker when the rocker is not assembled with the bridge.

* * * * *